United States Patent [19]

Harrah

[11] 4,324,507

[45] Apr. 13, 1982

[54] AUTOMATICALLY-CONTROLLED BUOYANCY VEST

[76] Inventor: Shane Harrah, 700 Coleman Ave., Apt. 7, Menlo Park, Calif. 90425

[21] Appl. No.: 139,812

[22] Filed: Apr. 14, 1980

[51] Int. Cl.[3] ..... B63C 11/02

[52] U.S. Cl. ..... 405/186; 441/92; 441/96

[58] Field of Search ..... 9/316, 319, 314, 342; 114/315, 317; 405/186; 137/81.2; 2/2 R

[56] References Cited

U.S. PATENT DOCUMENTS

| | | | |
|---|---|---|---|
| 3,487,647 | 1/1970 | Brecht | 114/315 X |
| 3,747,140 | 7/1973 | Roberts | 9/319 |
| 3,820,348 | 6/1974 | East | 114/315 X |
| 3,964,266 | 6/1976 | Bartlett | 114/315 X |
| 4,009,583 | 3/1977 | Buckle | 114/315 X |
| 4,114,389 | 9/1978 | Bohmrich | 9/316 X |

*Primary Examiner*—Trygve M. Blix
*Assistant Examiner*—John C. Paul

[57] ABSTRACT

Apparatus for maintaining the same total buoyancy of a scuba diver at all depths including means for re-setting total buoyancy and for maintaining the new buoyancy automatically. This apparatus includes a flexible air vest and an air valve system, with the air valve system being adjustable, by means of a knob, to compensation for different wetsuits, and having a failsafe feature.

21 Claims, 8 Drawing Figures

AUTOMATICALLY-CONTROLLED BUOYANCY VEST

FIELD OF THE INVENTION

This invention relates to automatic buoyancy regulating apparatus for scuba divers.

BACKGROUND OF THE INVENTION

In recent years considerable time and effort has been devoted to improvements in buoyancy apparatus for scuba divers for increasing safety and convenience when ascending and descending in the water, so better buoyancy control is possible. A number of Letters Patents of the United States have been granted on such improvements. U.S. Pat. No. 3,964,266 to Bartlett discloses a buoyancy compensating back pack assembly, using a container of pressurized air having a depth actuated control valve with two outlets. One outlet is connected to a mouthpiece for providing air to the diver. The second outlet is also connected to a mouthpiece and to a confined air space that provides buoyancy in the water; the air exhaled by the diver may be passed by this second mouthpiece to the confined air space to provide increased buoyancy. This apparatus cannot automatically compensate for changes in the buoyancy of the diver's foam rubber wetsuit, and it has no failsafe features. Buckle, in U.S. Pat. No. 4,009,583, discloses a buoyancy control apparatus that includes a waterproof reservoir having a compressed air valve and a water valve. Compressed air or water is selectively introduced into the reservoir through the valves, with one fluid displacing the other, to increase or decrease the buoyancy. This apparatus cannot compensate automatically for wetsuit buoyancy changes, and it has no failsafe features. Another buoyancy compensation apparatus is U.S. Pat. No. 4,114,389, granted to Bohmrich et al, which employs a constant volume chamber that is controllably pressurized through the diver's scuba tank, with water being alternately admitted into the chamber by one of two valves. Again this apparatus cannot compensate automatically for changes in the wetsuit's buoyancy, and it does not contain any failsafe features. Buoyancy control apparatus is also disclosed in U.S. Pat. No. 3,747,140, granted to Roberts, which employs an air-filled vest with manually controllable air valve means for introducing compressed air from the scuba tank into the air vest when extra buoyancy is desired. This apparatus cannot automatically compensate for any buoyancy changes.

East's U.S. Pat. No. 3,820,348 discloses automatic buoyancy regulating apparatus, including flexible bladders that inflate (deflate) as their volume tends to decrease (increase) so as to maintain approximately constant bladder volume and buoyancy. A predetermined buoyancy is maintained by means of a stationary plate and a movable plate on opposite sides of each air bladder, with a tensioned cable surrounding these bladders and connected to valve means. When the surrounding water pressure increases (decreases), the moveable plates move toward (away from) the stationary plates, causing the cable's tension to decrease (increase). The cable then opens a valve causing air to enter (exit) the bladders, thus expanding (compressing) the bladders until the cable closes the valve. This cable's tension is also influenced by a pad of wetsuit material sandwiched between two plates, so that its tension monitors changes in the diver's wetsuit density and the wetsuit's corresponding buoyancy. Thus East's apparatus can compensate for changes in the wetsuit's buoyancy. However, this apparatus does not contain a convenient knob for fine tuning the apparatus to compensate for different wetsuits, nor does it contain any failsafe features to insure that the diver can manually control his buoyancy if necessary.

The present invention contains a convenient knob for fine tuning the apparatus to compensate for different wetsuits, it has failsafe features to insure that buoyancy can be manually controlled if necessary, and it can take the form of conventional buoyancy vests which are safer to use and more comfortable to wear than East's apparatus.

SUMMARY OF THE INVENTION

A primary object of the present invention is to provide an improved auto buoyancy vest for scuba divers which automatically maintains a set buoyancy at all depths. If a scuba diver is using conventional equipment, his total buoyancy changes whenever he changes depth, but this inconvenience can be avoided if the diver uses the present invention. Normally when a diver changes depth, the surrounding water pressure changes, which changes the thickness of his air vest and buoyant wetsuit so their displacement of water changes and thus their buoyancy changes.

Another important object of the invention is to provide a facile method of changing one's buoyancy while scuba diving.

A still further object of the invention is to provide an automatic buoyancy regulation vest for scuba divers that includes an adjustable means for compensating for any size of wetsuit.

Other objects of the invention, together with some of the advantageous features thereof, will appear from the following description of a preferred embodiment, which is illustrated in the accompanying drawings.

The present buoyancy regulating apparatus includes a first chamber, open to the water, that contains a pad of compressible wetsuit material; a first extension spring, contained in the first chamber, whose tension increases with increasing compression of the wetsuit pad; a fine tuning knob for establishing the number of the first spring's coils held in tension; a second, gas-filled chamber, separated from the first chamber by a flexible, waterproof diaphragm; a movable connecting bar, attached at one end to the first spring, that passes through this diaphragm; a second extension spring, contained in the second chamber and coaxial with the first spring, that is attached to the second end of the movable connecting bar such that as one spring's tension increases, the other spring's tension decreases; gas inlet and outlet valves, adjacent to the second chamber, which are operatively associated with the movable connecting bar so that when the tension in the springs changes, gas flows into or out of the second chamber; a source of compressed gas that is pneumatically connected to the gas inlet valve; a flexible bladder, with a hole in its front wall where the open end of the second chamber is attached, and with the second spring connected between the bladder's back wall and the connecting bar such that as the bladder expands, the tension in the second spring increases; a set of internal extension springs connected between the bladder's front wall and back wall; and a buoyancy control means coupled to the compressible pad for adjusting the tension in the two springs which are coupled to the valves. The unique mechanical arrangement of the first and second springs in relationship to the other components, and the unique design of the flexible air bladder, employing a set of internal springs, are responsible for some of the primary advantages of the present invention.

DETAILED DESCRIPTION OF THE ILLUSTRATED EMBODIMENT

In its preferred form, the auto buoyancy vest for scuba divers comprises a flexible inner air bladder consisting of flexible plates held by springs in uniformly spaced-apart relationship and encased in a flexible outer container together with a valve system for automatically adjusting the amount of air under pressure in the vest whenever the diver changes depth.

Figure 1:
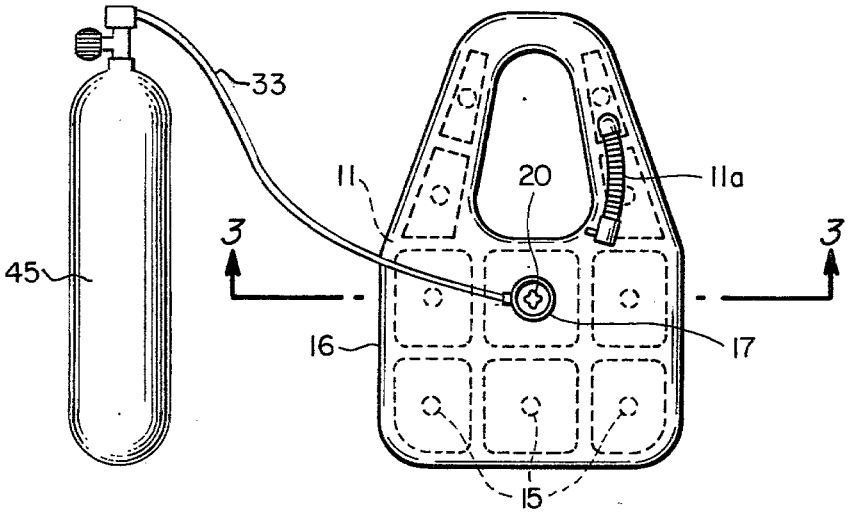
FIG. 1 is a front view of a preferred embodiment of my automatic buoyancy vest.
Figure 2:
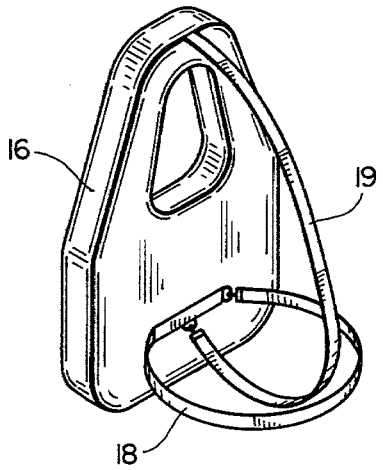
FIG. 2 is a rear perspective view of the vest shown in FIG. 1 which includes body straps for detachably securing the vest to the body.
Figure 3:
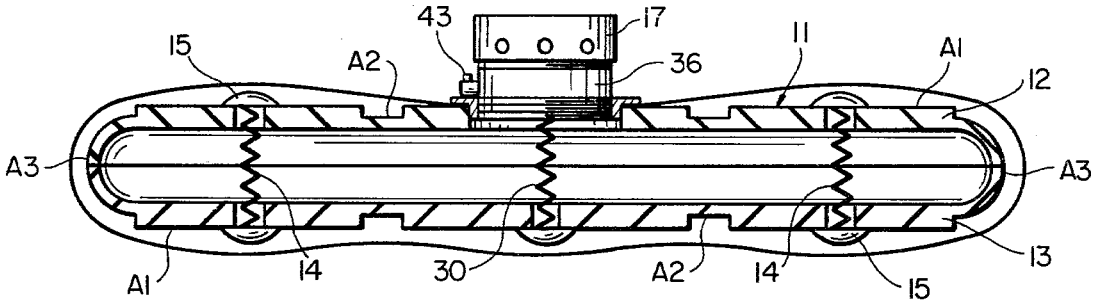
FIG. 3 is a sectional top view of the vest taken on line 3—3 of FIG. 1.

In accordance with my invention, I provide an air bladder 11 that is formed of two pieces 12 and 13 of a moderately flexible elastomer, such as rubber. As illustrated in FIGS. 1 and 3, each of these pieces has numerous areas A1 where the material is thick enough to be substantially inflexible, and each has relatively thin (e.g., one fifth the thickness of the thick areas) areas A2 which are flexible. The two pieces 12 and 13 are uniformly spaced-apart throughout all areas thereof by extension springs 14 anchored to the thick areas of each piece by spring connectors 15 to define a vest of relatively narrow cross-section. The two pieces 12 and 13 have thin, flexible areas A3 where the pieces are joined together, and the pieces 12 and 13 are encased within an envelope 16 of flexible fabric so as to provide a protective covering for the air bladder 11. In the front, center area of the vest, I provide a valve system for automatically inflating and deflating the vest, such valve system being manually controllable with a buoyancy adjustment handle 17. In order to utilize the vest on the front of a diver's body, I provide body straps 18 and 19 that are secured to the back of the vest by suitable stitching in operative positions, as illustrated in FIG. 2. I also provide a hose 11*a* (FIG. 1) connected to the air bladder, for orally inflating the vest if necessary.

Figure 4:
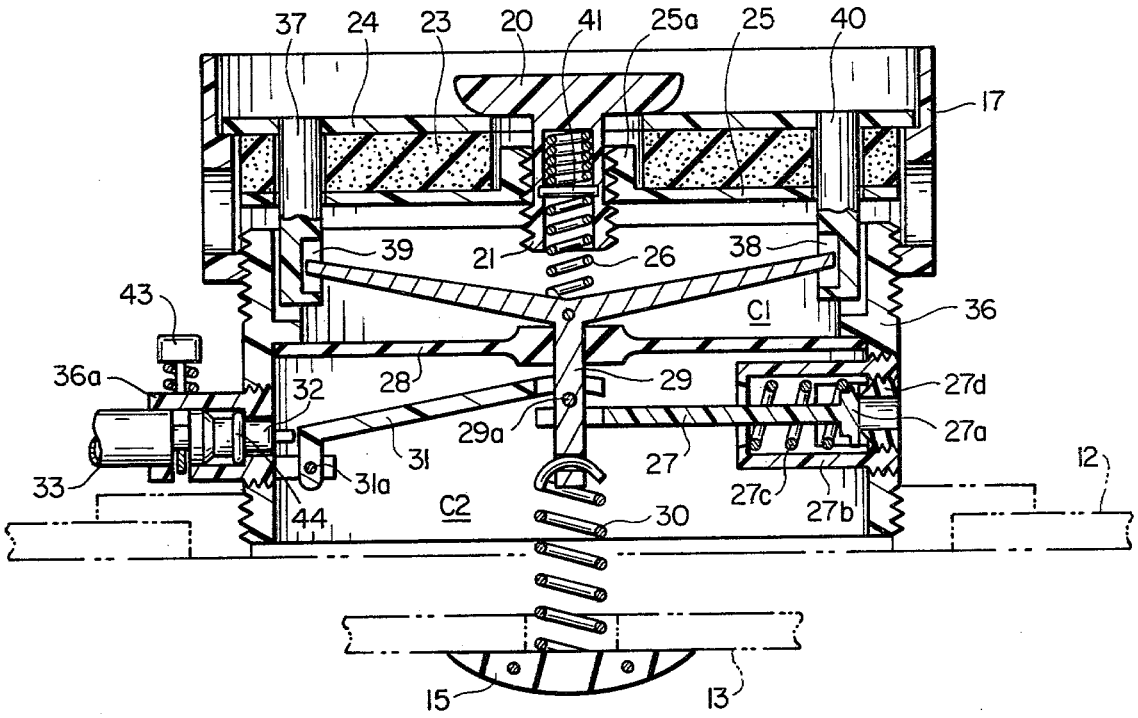
FIG. 4 is an enlarged cross-sectional top view, taken on line 3—3 of FIG. 1, of a preferred valve structure employed in the preferred embodiment of my auto buoyancy test.
Figure 5:
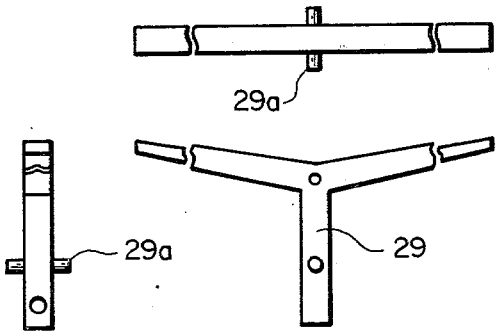
FIG. 5 shows three orthographic views of valve part 29.

In FIG. 4 of the annexed drawings, I have illustrated the valve system which I employ in the preferred embodiment of my present invention, the system being shown in enlarged view. As illustrated, I provide a manually-rotatable knob 20 for fine tuning the valve system to compensate for different wetsuit sizes. This knob has a threaded tubular section 21 that can engage a threaded tube 25*a* in the center of a circular rigid plate 25. Glued between this plate and another circular rigid plate 24 there is a circular sheet 23 of wetsuit material, such as neoprene foam, which compresses when water pressure is exerted on it. A relatively strong helical extension spring 26 is connected to the tubular section 21 (of the knob) by a metal rod 41 that fits between 2 of the spring's coils. This rod is firmly embedded in the wall of tubular section 21, so that when knob 20 is rotated this rod also rotates and thus changes the number of spring coils held in tension. Because a spring's stiffness (i.e., spring rate K: the ratio between a spring's force and its deflection) depends on the number of coils held in tension, the fine tuning knob 20 adjusts spring 26's stiffness when the knob is rotated. Note that when the foam rubber sheet 23 is compressed by water pressure, plate 25 moves toward plate 24, thus moving knob 20 and stretching spring 26 further (assuming the knob's threaded section 21 engages the threaded section 25*a* of plate 25). Because a spring's tension is proportional to the length it is stretched, spring 26's tension is proportional to the thickness change of foam rubber sheet 23. This rubber sheet's thickness change is proportional to thickness change of the diver's rubber wetsuit, and the wetsuit's thickness change is proportional to wetsuit's buoyancy change when the diver changes depth. Therefore a tension change in spring 26 is proportional to the change in buoyancy of the diver's wetsuit, and the proportionality constant is determined by the setting of the fine tuning knob 20. This knob's setting should be different for different wetsuits, since their buoyancy change: depth change ratios would differ. Note that in FIG. 4 the threads of knob 20's tubular section are not engaged with the threads in plate 25's tubular section; the knob 20 simply is resting on plate 24. When the fine tuning knob 20 is in this setting, the tension of spring 26 does not change when the foam rubber sheet 23 is compressed by water pressure. The knob should be in this setting when the diver is not wearing any wetsuit.

Spring 26 links the movements of the foam rubber sheet 23 with the air inlet and outlet valves. As shown in FIG. 4, spring 26 is joined to a connector bar 29 made of a strong, rigid material, such as steel. This connector bar determines the positions of the air valves' control levers 27 and 31. The design of this connector bar provides a failsafe feature in the event that either of the valve control springs 26 and 30 breaks due to fatigue; even if the automatic functioning of the valve system ceases due to a broken spring, connector bar 29 is designed such that the diver can still manually control the air valves with the buoyancy adjustment handle 17. The connector bar 29 has arms whose ends fit into slots 38 and 39 in rods 37 and 40, which are rigidly connected to plate 24. When valve springs 26 and 30 are functioning normally, the arms of connector bar 29 can slide for a limited distance inside slots 38 and 39, but if one of these valve springs breaks, the other spring will hold the arms in a stationary position after pulling the arms to one end of the slots 38 and 39. With the arms held in this position by one spring, the air valves can be manually operated by changing the positions of rods 37 and 40, using the manually-rotatable buoyancy adjustment handle 17 to change the position of plate 24. Thus the air valves are always mechanically linked indirectly to the buoyancy adjustment handle even if a valve spring breaks.

In order to prevent air from uncontrollably escaping from the valve system, the connector bar 29 is embedded in a flexible circular diaphragm 28, possibly a rubber sheet, that separates a chamber C2 exposed to the vest's air from a chamber C1 open to sea water. The outer rim of this diaphragm is firmly attached to the inner wall of the valve system's casing 36, as illustrated in FIG. 4.

Embedded in connector bar 29 is a relatively small, perpendicularly oriented rod 29*a* that can engage the forked ends of either valve control lever 27 or 31, depending on what position connector bar 29 is in. As is evident from FIG. 4, when the foam rubber sheet 23 decreases in thickness, spring 26 and connector bar 29 are pulled toward plate 24. When this occurs the rod 29*a* engages the end of the air inlet valve control lever 31, and this lever is rotated counterclockwise. In situations when the air bladder 11 expands, spring connector 15 and extension spring 30 pull connector bar 29 away from plate 24. When this occurs rod 29*a* engages the end of the air outlet valve control lever 27, and this lever is rotated counterclockwise. In each instance, an air valve is opened when its control lever is rotated counterclockwise. FIG. 4 illustrates the neutral position where neither air valve is open. The connector bar 29 remains in this neutral position whenever the tensions in valve springs 26 and 30 are equal.

Figure 8:
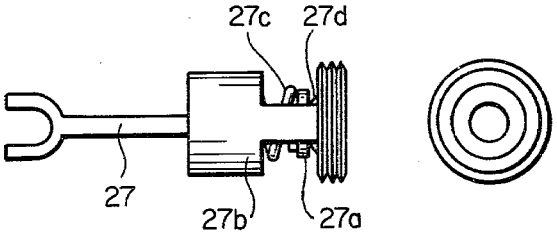
FIG. 8 shows front and right side views of the air outlet valve, which is inside the valve structure shown in FIG. 4.

The air outlet valve is illustrated in FIGS. 4 and 8. This valve consists of a control lever 27 with a piston 27*a* at one end, a valve casing 27*b*, a rubber gasket 27*d*, and a compression spring 27*c* which presses the piston against the gasket. Air can escape when the piston is tilted away from the rubber gasket, thus deflating the vest.

Figure 6:
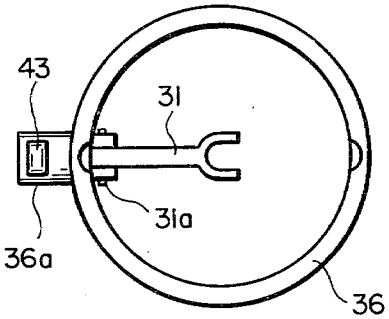
FIG. 6 shows a front view of valve system parts 31, 31*a*, 36 and 36*a*.
Figure 7:
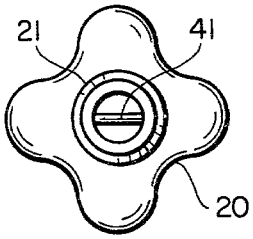
FIG. 7 is a back view of valve part 20, the hand knob for fine tuning the automatic valve system.

The air inlet valve components are illustrated in FIGS. 4 and 6. This valve means consists of a pivoting control lever 31, a pivot rod 31*a*, a valve casing 36*a*, and a pin-activated inflation valve 32 at the end of a hose 33 leading from a compressed gas tank (such as an air-filled scuba tank 45). When control lever 31 is rotated counterclockwise, it depresses the pin of inflation hose valve 32 and thus opens this valve, causing the vest to inflate. The connector bar 29 and the valve control levers 27 and 31 together form a movable linkage means which couples springs 26 and 30 to the air inlet and air outlet valves. Thus springs 26 and 30 are operatively associated with the two air valves: when the springs' tensions are different, they move the linkage means, which opens one of the two air valves while keeping the other air valve closed.

This arrangement of components in the present invention insures that the diver's total buoyancy automatically remains constant despite changes in his depth. If the diver descends a few feet, his wetsuit and air-filled vest become more compressed so his buoyancy decreases temporarily. Because the air bladder's thickness has decreased, spring connector 15 is closer to plate 24 so spring 30's tension has decreased. This decrease in tension is proportional to the decrease in the air bladder's buoyancy. Because the set of bladder springs 14 insures that the thickness of the air bladder is uniform everywhere, the thickness of the air bladder at valve spring 30's location is proportional to the air bladder's volume, which is proportional to the air bladder's buoyancy. Thus the spring's tension is also proportional to the bladder's buoyancy. If the diver has descended, the foam rubber sheet 23 also has decreased in thickness so valve spring 26's tension has increased. (As previously explained, this change in spring tension is proportional to the wetsuit's buoyancy change.) Because valve spring 26's tension has increased and valve spring 30's tension has decreased, connector bar 29 moves toward plate 24 and causes the air inlet valve control lever 31 to rotate counterclockwise. This action causes the valve to open, and the air bladder inflates further. Inflation continues until the air bladder's buoyancy has increased sufficiently to compensate for the decrease in the wetsuit's buoyancy. Inflation causes the air bladder to expand until the valve spring 30 stretches enough that its tension is slightly greater than spring 26's tension. Then spring 30 pulls connector bar 29 back to the neutral position illustrated in FIG. 4, which causes inflation to cease and equalizes the tensions in valve springs 26 and 30. Thus the diver's total buoyancy (i.e., vest buoyancy plus wetsuit buoyancy) automatically remains constant when the diver descends.

Similarly if the diver ascends, the tension of valve spring 30 increases and the tension of valve spring 26 decreases, so connector bar 29 moves away from plate 24 and it causes the air outlet valve control lever 27 to rotate counter-clockwise, thus opening the air outlet valve. Deflation continues until the air bladder's buoyancy has decreased sufficiently to compensate for the increase on the wetsuit's buoyancy. At that time the valve spring 26 pulls connector bar 29 to its neutral position illustrated in FIG. 4, which causes deflation to cease and equalizes the tensions in valve springs 26 and 30. Thus the valve system automatically compensates for buoyancy changes when the diver ascends.

It should be noted that the valve system does not inflate or deflate when the diver's depth remains constant. Also note that if the threaded section 21 of the fine tuning knob is not engaged with the threaded section 25*a* of plate 25, as illustrated in FIG. 4, the valve system simply maintains the air bladder's buoyancy at a constant level.

It is further to be observed that the diver may change his buoyancy whenever he desires by twisting the threaded, cylindrical buoyancy adjustment handle 17. When this handle is twisted, the position of plate 24—which rests on a rim of this handle—changes, and this changes valve spring 26's tension. If this tension has been increased, connector bar 29 is pulled toward plate 24 and air inlet valve control lever 31 is rotated counterclockwise. The air bladder then inflates until the connector bar 29 returns to its neutral position illustrated in FIG. 4. At this moment, the tension in valve spring 30 has increased enough that its tension is equal to spring 26's tension, and the air bladder's volume and buoyancy have increased to a new, stable level. The opposite result occurs if the buoyancy adjustment handle 17 is twisted such that spring 26's tension is reduced: this causes the vest to deflate for a moment, and then the air bladder's buoyancy remains at a new, reduced level. Once the diver has set his buoyancy level by twisting handle 17, his total buoyancy will remain constant at all depths unless he voluntarily resets handle 17. I have provided holes around the cylindrical wall of handle 17 so that the diver's fingers can easily grasp and rotate the handle, as illustrated in FIG. 3.

In FIG. 4, I have illustrated the preferred embodiment of my improved valve system which is associated with the preferred embodiment of my auto buoyancy vest as exemplified by air bladder 11, including the twistable buoyancy adjustment handle 17 which is internally threaded for engaging the externally threaded valve system casing 36. The buoyancy adjustment handle 17 and the valve system casing 36 together form a hollow housing which contains the valve system's components. (These two components form a cylinder with a hollow interior.) In order to prevent the rotation of the foam rubber sheet 23 and plates 24 and 25 when the handle 17 is twisted, I provide the plate 24 with rigidly-attached perpendicular rods 37 and 40 that are arranged to slide within grooves on the inner wall of casing 36 so that the grooves prevent plates 24 and 25 from rotating.

To insure that the pin-activated valve 32 is held firmly in its proper position, as illustrated in FIG. 4, I provide a spring-loaded push-button mechanism 43 for locking the inflation hose 33 to an extension 36*a* of the valve system casing 36. It should be observed here that near the inner end of the hose 33 I provide an O-ring 44 thereon that creates a water-tight seal at this juncture.

It should be observed that in the preferred embodiment of the valve system, the connector bar 29's design insures that the valve springs do not rotate when knob 20 is rotated.

Figure 9:
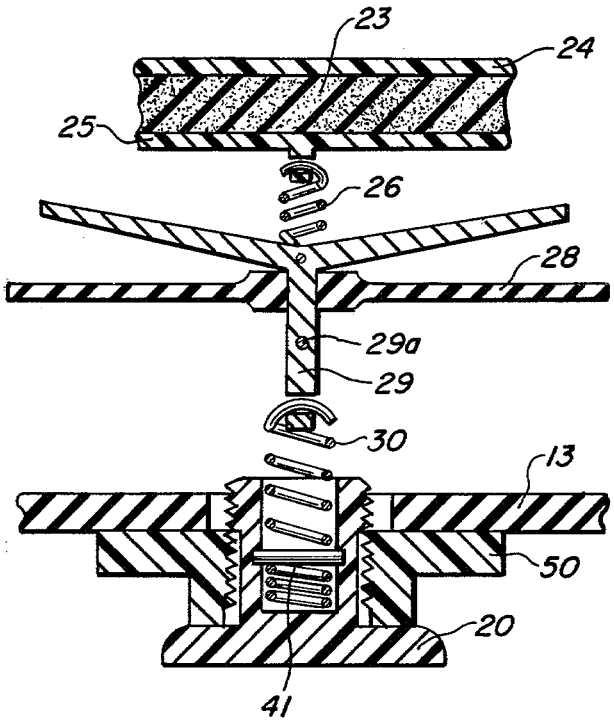
FIG. 9 illustrates an enlarged cross-sectional top view, taken on line 3—3 of FIG. 1, of a modified arrangement of some of the parts in the valve structure, with the fine-tuning knob 20 oriented in a different position relative to the springs 26 and 30.

In a modified embodiment, as illustrated in FIG. 9, the knob 20 could be located where spring 30 connects to the wall of the air bladder so that knob 20 could adjust the spring rate K of spring 30. The knob's purpose would be the same. It should be noted that except for the changes shown in FIG. 9, this modified embodiment is identical to the preferred embodiment shown in FIG. 4. This modified embodiment includes all of the same components as the preferred embodiment shown in FIG. 4, although not all of these components are illustrated in FIG. 9.

Although the present invention is superficially similar to the invention described in East's U.S. Pat. No. 3,820,348, the present invention has several design features that are significant improvements. One such improvement is the presence of the convenient knob 20 for fine tuning the valve system to compensate for different wetsuit sizes. When using East's invention, the diver must remove the pad of wetsuit material from the invention and replace it with a new pad of a different size whenever he changes to new wetsuit of a different thickness. This inconvenience can be avoided when using the present invention; the diver simply twists a knob by an appropriate amount whenever he changes wetsuits. The unique mechanical interrelationship between this knob and the valve spring 26 allows the knob to control the ratio between a change in the valve spring's tension and a change in the foam rubber sheet 23's thickness. (Note that this ratio determines how much the air bladder's buoyancy will change when the diver's wetsuit buoyancy changes, and the proper buoyancy compensation ratio depends on the wetsuit's size.) In the valve system embodiment shown in FIG. 4, knob 20 sets the spring rate K of valve spring 26 by determining the number of spring coils held in tension, and thus this knob can set the buoyancy compensation ratio for a particular wetsuit. Because the air valves in East's invention are controlled by a single cable whose tension depends on both the volume of the air bladder and the thickness of the wetsuit pad, his invention could not be adjusted to compensate for different wetsuits even if the diver could change the spring constant of any of the springs. Using a separate spring (e.g. spring 26 in my invention ) to interconnect the wetsuit pad and the air valves makes adjustment possible, since the spring rate of that spring can be changed without changing the spring rate of the spring (e.g., part 30) that interconnects the air bladder and the air valves. (Remember that in order to compensate for different wetsuits, the ratio between these two spring rates should be adjustable.) Therefore the present invention is adjustable, due to the unique mechanical relationship of the wetsuit pad 23, knob 20 (including rod 41), springs 26 and 30, the air valves, and the air bladder.

Another improvement in the present invention is the unique design of the air bladder. The bladder springs 14 insure that the thicker, more rigid areas A1 of bladder pieces 12 and 13 are uniformly spaced apart regardless of the air volume in the bladder, and the presence of thinner, flexible areas A2 (which are located between the rigid areas A1, as illustrated in FIG. 3) of pieces 12 and 13 insures that the air bladder has good overall flexibility. It is important that all areas of the air bladder pieces 12 and 13 are equally spaced apart so that the tension in valve spring 30 is proportional to the air bladder's buoyancy. This insures that the valve system functions properly. It is also important that the air bladder has good overall flexibility so that it can comfortably fit the contours of the diver's body when worn. Unlike East's invention, which is encased in a rigid housing and is worn on the diver's back, the present invention can take the form of a conventional buoyancy vest such as illustrated in FIG. 2, which can hold a scuba diver's head above water when he is at the surface. If a scuba diver becomes unconscious at the surface, the East invention would hold the diver's head face-down because the diver wears it on his back, unlike the present invention. The housing of East's invention is too bulky and rigid to be worn comfortably on the diver's chest as conventional buoyancy vests are worn, so the present apparatus is safer and more comfortable to wear than East's invention. Thus the unique design of the air bladder in the present invention is a significant improvement.

A third improvement of the present invention is its failsafe feature. In both East's invention and the present invention, the valve springs are the most likely parts to suffer fatigue failure and thus break. If one of these springs breaks, the valve system can no longer function automatically. The present invention is designed so that the vest's buoyancy can still be manually controlled with the buoyancy adjustment handle 17, unlike East's invention. As illustrated in FIG. 4, the air valves are always indirectly mechanically linked to the buoyancy adjustment handle, even if a valve spring breaks. Thus the unique mechanical arrangement of parts 17, 24, 29, 37, and 40 provides a failsafe feature for the valve system embodiment shown in FIG. 4. Thus the present invention is safer than East's apparatus.

The present invention can also automatically compensate for buoyancy changes somewhat more accurately than East's invention can, because the foam rubber sheet 23 in the present invention simulates the compression of the diver's wetsuit more accurately. This is true because the valve springs 26 and 30 amplify thickness changes in this rubber sheet so the sheet can be thinner than the neoprene pad in East's invention. (The valve springs magnify, by a factor proportional to the ratio of the spring rates of spring 26 and spring 30, the effect that a given thickness change of sheet 23 has on the thickness of the air bladder.) Because the diver's wetsuit is relatively thin, a thin rubber sheet can simulate a wetsuit when under pressure somewhat better than a thicker sheet can. Therefore, the present invention's unique mechanical interrelationship of the rubber sheet, the valve springs, and the air valves can compensate for the wetsuit's buoyancy changes more accurately than East's invention can.

It will be appreciated that while one particular embodiment of the invention has been shown and described modifications may be made. It is intended in the claims to cover the modifications which fall within the spirit and scope of the invention.

I claim:

1. Buoyancy regulating apparatus for scuba divers, and the like, comprising:

a stationary plate;

a movable plate, spaced apart from said stationary plate;

a sheet of compressible material similar to a diver's wetsuit material, positioned between and in contact with said stationary plate and said movable plate;

a first tensioned spring with first end coupled to said movable plate, with said compressible sheet being operatively associated with said first spring such that as said movable plate moves toward said stationary plate, the tension in said first spring increases;

a movable connecting bar mechanically coupled to the second end of said first spring;

a hollow housing, with said stationary plate positioned at first end of said housing, that contains said compressible sheet, said movable plate, said first spring, and said connecting bar in the housing interior;

a flexible, waterproof diaphragm, through which said connecting bar passes, that is attached to the interior side walls of said housing, for defining a first chamber, which is open to the surrounding water, between said stationary plate and said diaphragm, and for defining a gas-filled second chamber between said diaphragm and the second end of said housing;

flexible bladder means, with front wall of said bladder means connected to said second end of said housing such that gas can flow between said bladder means and said second chamber of said housing;

a second tensioned spring, substantially coaxial with said first spring, with first end mechanically coupled to said connecting bar and the second end operatively associated with the back wall of said bladder means, such that said second spring's tension increases as said bladder means expands;

a source of compressed gas, such as the diver's scuba tank;

first valve means, positioned adjacent to said second chamber of said housing, for admitting gas from said compressed gas source into said second chamber;

a first rotatable valve control arm, operatively associated with said connecting bar and with said first valve means, for opening and closing said first valve means in response to movement of said connecting bar toward or away from said compressible sheet, such that gas flows from said gas source through said second chamber and then into said bladder means whenever said compressible sheet or said bladder means is further compressed;

second valve means, positioned adjacent to said second chamber of said housing, for releasing gas from said second chamber into the surrounding water;

a second rotatable valve control arm, operatively associated with said connecting bar and with said second valve means, for closing and opening said second valve means in response to movement of said connecting bar toward or away from said compressible sheet, such that gas flows from said bladder means through said second chamber and then out to the surrounding water whenever said compressible sheet or said bladder means further expands; and suspension means attached to said bladder means for supporting the apparatus on a diver.

2. Buoyancy regulating apparatus according to claim 1, which further includes a manually operable control means mechanically coupled to said stationary plate for establishing the distance between said stationary plate and the second end of said housing, so that the buoyancy of said bladder means can be adjusted.

3. Buoyancy regulating apparatus according to claim 2, which further includes a second manually operable control means for adjusting said first spring's stiffness by establishing the number of said spring's coils held in tension, so that the apparatus can be fine tuned to compensate for different wetsuits.

4. Buoyancy regulating apparatus according to claim 2, which further includes a second manually operable control means for adjusting said second spring's stiffness by establishing the number of said second spring's coils held in tension, so that the apparatus can be fine tuned to compensate for different wetsuits.

5. Buoyancy regulating apparatus according to claim 3, in which said second control means includes a manually rotatable shaft, essentially coaxial with said first spring and linked to said movable plate, with an attached perpendicular rod that fits between two adjacent coils of said first spring for coupling said first spring to said shaft.

6. Buoyancy regulating apparatus according to claim 3, in which said second control means includes a control handle capable of coupling said first spring to either said movable plate or said stationary plate.

7. Buoyancy regulating apparatus according to claim 2, which further includes failsafe bars, operatively associated with said first control means, that are positioned adjacent to said connector bar and limit the distance that said connector bar can move relative to said stationary plate, thus insuring that said first control means is mechanically linked to said connector bar even if said first spring breaks.

8. Buoyancy regulating apparatus according to claim 1, which further includes a set of springs mechanically coupling the inner sides of said bladder's front and back walls for holding said walls in a uniformly spaced apart relationship, regardless of the distance between said walls.

9. Buoyancy regulating apparatus according to claim 8, in which the ends of said bladder springs are anchored to numerous essentially rigid areas of said walls, with flexible areas of said walls separating these rigid areas.

10. Buoyancy regulating apparatus according to claim 9, in which said walls are relatively thick in the rigid areas and are relatively thin in the flexible areas.

11. Buoyancy regulating apparatus according to claim 9, which further includes a first manually operable control means mechanically coupled to said stationary plate for establishing the distance between said stationary plate and said second end of said housing, and a second manually operable control means, connected to said first spring and to said movable plate, that establishes the number of said first spring's coils held in tension.

12. Buoyancy regulating apparatus according to claim 11, in which said first control means includes a rotatable handle, coupled to said stationary plate, with a threaded section that engages a threaded section of said housing, and said second control means includes a knob with a rotatable threaded shaft, connected to said first spring, for coupling said knob to a threaded section of said movable plate and for decoupling said knob from this threaded section of said movable plate.

13. Buoyancy regulating apparatus according to claim 12, which further includes failsafe bars, operatively associated with said first control means, that are positioned adjacent to said connector bar and limit the distance that said connector bar can move relative to said stationary plate.

14. Buoyancy regulating apparatus according to claim 1, in which said compressed gas source is pneumatically coupled to said first valve means by a hose that can be disconnected from said first valve means.

15. Buoyancy regulating apparatus for scuba divers, and the like, comprising:

a stationary plate;

a movable plate, spaced apart from said stationary plate;

a sheet of compressible material similar to a diver's wetsuit material, positioned between and in contact with said stationary plate and said movable plate;

a first tensioned spring with first end mechanically coupled to said movable plate, with said compressible sheet being operatively associated with said first spring such that as said movable plate moves toward said stationary plate, the tension in said first spring increases;

a first chamber, which is open to the surrounding water, with said stationary plate positioned at first end of said first chamber, that contains said compressible sheet, said movable plate, and said first spring in the chamber's interior;

flexible bladder means;

a water proof gas-filled second chamber, with second end of said second chamber pneumatically coupled to front wall of said bladder means such that gas can flow between said bladder means and said second chamber;

a second tensioned spring, with the second end of said second spring operatively associated with the back wall of said bladder means, such that said second spring's tension increases as said bladder means expands;

a source of compressed gas, such as the diver's scuba tank;

first valve means, positioned adjacent to said second chamber, for admitting gas from said compressed gas source into said second chamber;

second valve means, positioned adjacent to said second chamber, for releasing gas from said second chamber into the surrounding water;

a movable linkage means, with first end of said linkage mechanically coupled to second end of said first spring and with second end of said linkage mechanically coupled to first end of said second spring, with said linkage being operatively associated with said first valve means for opening and closing said first valve means such that gas flows from said gas source through said second chamber and then into said bladder means whenever said compressible sheet or said bladder means is further compressed, and with said linkage being operatively associated with said second valve means for opening and closing said second valve means such that gas flows from said bladder means through said second chamber and then out to the surrounding water whenever said compressible sheet or said bladder means further expands;

a waterproof diaphragm, attached to the first end of said second chamber, with said linkage means passing through said diaphragm such that first end of said linkage is positioned outside said second chamber and second end of said linkage is positioned inside said second chamber; and suspension means attached to said bladder means for supporting the apparatus on a diver.

16. Buoyancy regulating apparatus according to claim 15, which further includes a first manually operable control means mechanically coupled to said stationary plate for establishing the distance between said stationary plate and the second end of said second chamber, so that the buoyancy of said bladder means can be adjusted.

17. Buoyancy regulating apparatus according to claim 16, which further includes a second manually operable control means for adjusting said first spring's stiffness by establishing the number of said first spring's coils held in tension, so that the apparatus can be fine tuned to compensate for different wetsuits.

18. Buoyancy regulating apparatus according to claim 17, in which said second control means includes a manually rotatable shaft, essentially coaxial with said first spring and linked to said movable plate, with an attached perpendicular rod that fits between two adjacent coils of said first spring for mechanically coupling said first spring to said shaft.

19. Buoyancy regulating apparatus according to claim 15, which further includes a set of springs mechanically coupling the inner sides of said bladder's front and back walls for holding said walls in a uniformly spaced apart relationship, regardless of the distance between said walls.

20. Buoyancy regulating apparatus according to claim 19, in which the ends of said bladder springs are anchored to numerous essentially rigid areas of said walls, with flexible areas of said walls separating these rigid areas.

21. Buoyancy regulating apparatus according to claim 20, which further includes a first manually operable control means mechanically coupled to said stationary plate for establishing the distance between said stationary plate and the second end of said second chamber, and a second manually operable control means, connected to said first spring and to said movable plate, that establishes the number of said first spring's coils held in tension.

* * * * *